US008413340B2

(12) United States Patent
Orlowski

(10) Patent No.: US 8,413,340 B2
(45) Date of Patent: Apr. 9, 2013

(54) SAFETY GUARD FOR POWER SAW

(76) Inventor: John Michael Orlowski, Norton, MA (US)

( * ) Notice: Subject to any disclaimer, the term of this patent is extended or adjusted under 35 U.S.C. 154(b) by 316 days.

(21) Appl. No.: 12/917,583

(22) Filed: Nov. 2, 2010

(65) Prior Publication Data

US 2011/0099819 A1 May 5, 2011

Related U.S. Application Data

(60) Provisional application No. 61/257,966, filed on Nov. 4, 2009.

(51) Int. Cl.
*B27G 19/04* (2006.01)
*B27B 5/29* (2006.01)

(52) U.S. Cl. ..... 30/391; 83/478

(58) Field of Classification Search ..... 30/388–391; 83/478

See application file for complete search history.

(56) References Cited

U.S. PATENT DOCUMENTS

| | | | | | |
|---|---|---|---|---|---|
| 1,811,577 | A * | 6/1931 | Crowe | 30/391 |
| 2,926,709 | A * | 3/1960 | Kaley | 83/478 |
| 3,063,481 | A * | 11/1962 | Sutherland | 30/391 |
| 3,177,909 | A * | 4/1965 | Laube et al. | 30/391 |
| 3,613,748 | A * | 10/1971 | De Pue | 30/391 |
| 3,730,239 | A * | 5/1973 | Kaman et al. | 30/391 |
| RE27,716 | E * | 8/1973 | Santilli | 30/389 |
| 3,787,973 | A * | 1/1974 | Beisch et al. | 30/391 |
| 3,805,639 | A * | 4/1974 | Peter | 74/616 |
| 4,799,416 | A * | 1/1989 | Kumasaka et al. | 83/397 |
| 5,075,976 | A * | 12/1991 | Young | 30/391 |
| 5,850,697 | A * | 12/1998 | Welch | 30/391 |
| 7,353,737 | B2 * | 4/2008 | Gass et al. | 83/62.1 |
| 7,426,787 | B2 * | 9/2008 | Tracy et al. | 30/391 |
| 2005/0252012 | A1 * | 11/2005 | Johnson | 30/391 |

* cited by examiner

*Primary Examiner* — Hwei C Payer

(57) ABSTRACT

A safety guard assembly for use on a handheld power saw is disclosed. The assembly includes a safety guard, a locking mechanism, and a weight. The safety guard is swingably mounted on the hood of the saw. The locking mechanism allows the guard to be swung to an open position and locked in position. In a kick-back situation, the locking mechanism quickly releases. The weight forces the guard to swing rapidly down over the guard, thereby providing protection from the saw blade.

5 Claims, 2 Drawing Sheets

SAFETY GUARD FOR POWER SAW

BACKGROUND INFORMATION

1. Field of the Invention

The invention relates to power saws. More particularly, the invention relates to a safety guard for such saws.

2. Discussion of the Prior Art

Handheld circular power saws are commonly used tools. Saw operations with a circular saw are inherently dangerous operations that require some skill in operation of the saw and a great deal of care. One of the well-known hazards of operating this type of saw is that "kick-back" can sometimes occur. This can happen for any number of different reasons, such as when the work piece shifts or binds, or the cutting operation is done too high on the blade. The upper half of the saw blade rotates away from the direction of the saw operator and for purposes of discussion, this direction will hereinafter be referred to as the counterclockwise direction. When, for example, the work piece binds, the high acceleration of the saw forces the saw to move upward and back toward the operator, hence the term "kick-back." It is possible for the operator to suffer severe, even lethal, cut injuries as a result of a kick-back.

What is needed, therefore, is a saw guard for handheld power saws that will prevent kick-back injuries.

BRIEF SUMMARY OF THE INVENTION

The invention is a blade guard for a hand-held power saw. The guard according to the invention is constructed such, that, upon kick-back, the guard immediately drops into place over the exposed portion of the saw blade, thereby preventing cut injuries to the operator, even if the saw should come into contact with the body of the operator.

The blade guard according to the invention works under the principle of inertia. The guard comprises two side members that cover the blade when the saw is not in use. The guard is held in the closed position by a spring-biased locking pin or plunger that is affixed to the hood. Inertial weights are provided on the side members.

The operator moves the locking pin from its locking position and raises the guard prior to use of the saw. The locking pin then snaps into a recess or detent on the guard to lightly secure the guard in the raised position. Should the saw kick back, inertia will cause the locking pin to pop out of the detent, allowing the guard to immediately swing closed and become locked in the closed position, thereby preventing the saw blade from injuring the operator.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
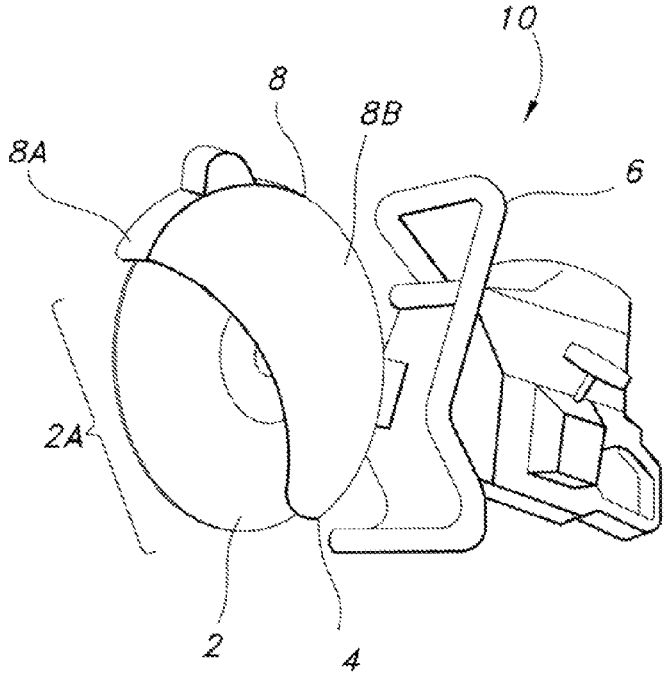
FIG. 1 (PRIOR ART)
FIG. 1 illustrates a conventional handheld circular saw (prior art).

FIG. 1 shows a conventional handheld circular saw 10. The saw has a saw blade 2 that is partially covered with a hood 8. The hood 8 encloses that portion of the saw blade 2 that is closest to the operator. A portion of the saw blade 2A remains unhooded, i.e., exposed, this portion being the operative area of the saw blade in a normal sawing operation. The saw 10 is held at the handle 6 by the operator. The particular illustration of the handheld circular saw 10 is that of a Husqvarna 371K concrete saw. This is for illustration purposes only and in no way limits the use of the inventive device to this brand or style of a power saw. The safety guard according to the invention described below may be used on various types of handheld saws that have a hood over at least an upper portion of the saw blade. For purposes of discussion, the hood 8 will be defined as having a front edge 8A that is on the upper portion of the hood and farthest away from and a rear edge 8B that is closest to the handle 6.

Figure 4:
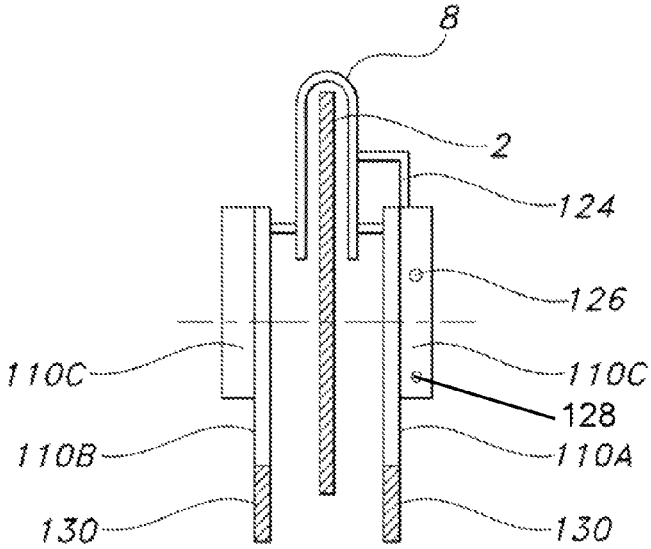
FIG. 4 is a front plan view of the circular saw blade, illustrating the hood and the two side members of the safety guard according to the invention.
Figure 2:
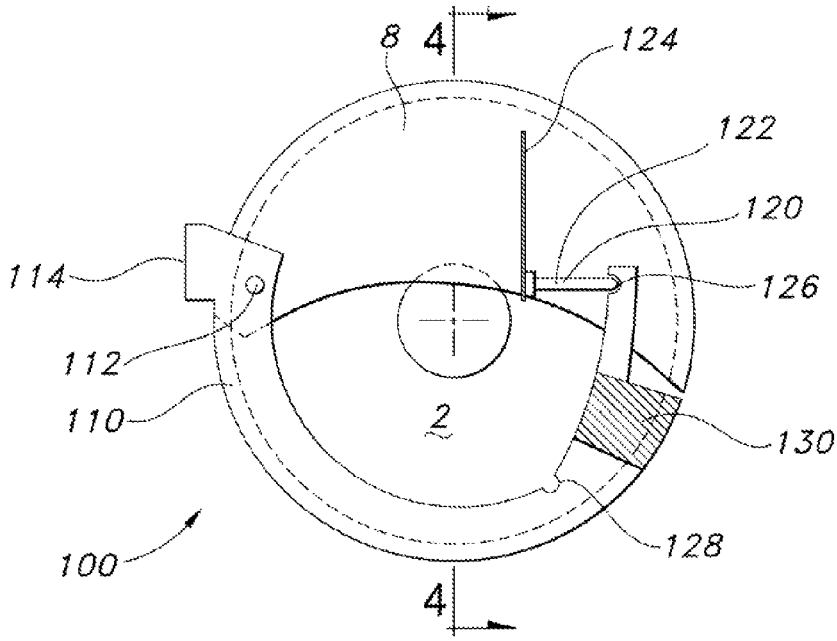
FIG. 2 is a side plan view of a circular saw blade, with a safety guard according to the invention affixed to the hood and in the closed position.
Figure 3:
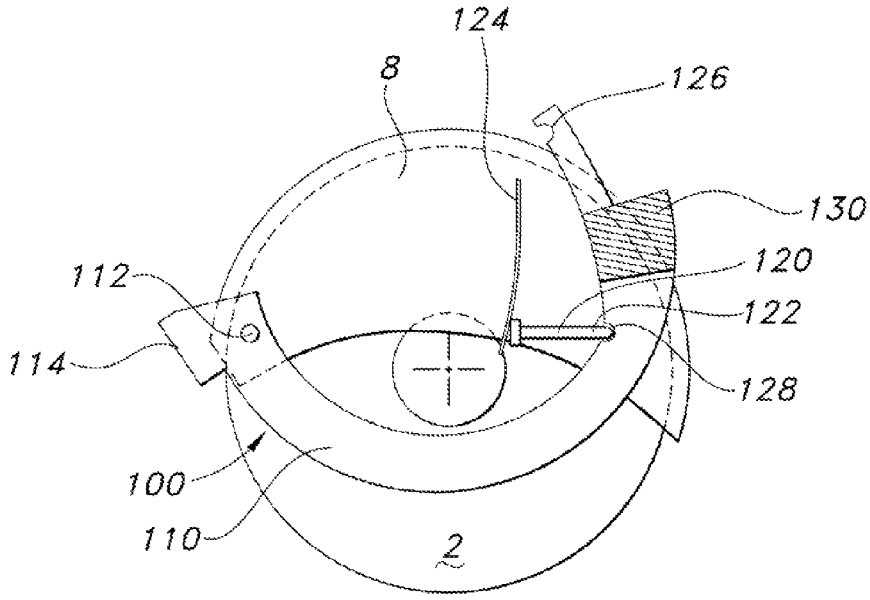
FIG. 3 is a side plan view of the circular saw blade of FIG. 2, with the safety guard according to the invention shown in the open position.

FIGS. 2-4 illustrate a saw blade guard 100 according to the invention that is suitable for installation on a conventional handheld circular saw, such as the saw 10. FIG. 2 is a side plan view of the saw blade guard 100, showing the guard 100 in a closed position, covering almost entirely the normally exposed or unhooded portion 2A of the saw blade 2. The guard 100 comprises a guard 110 that is pivotably affixed to the front edge 8A of the hood 8 via a pivot means 112. In the embodiment shown, the guard 110 includes two side members 110A, 1108 that are coupled to each other by means of a bridge 114, to ensure that the side members operate as a single unit. An example of a suitable pivot means 112 is a pivot pin or nub that is attached to or integrated into each side of the hood 8, with the guard 110 having an aperture or snap connector for rotatably affixing each side of the guard 110 or the bridge 114 to the respective pivot means 112.

A spring-biased locking means 120 in the form of a locking pin or plunger 122 is affixed to the hood 8 by conventional means. In the embodiment shown, the locking means 120 includes a leaf spring 124 that urges the locking pin 122 in a direction away from the pivot means 112, that is, toward the end of the saw 10 that is closest to the saw operator. The locking pin 122 is affixed to the lower end of the leaf spring 124. At least one side member 110 has a flange 110C at a rear portion of the guard 110 with a first detent or recess 126 for receiving the locking pin 122 to lock the guard 110 in a closed position, as shown in FIG. 4. It is also possible to provide a sleeve on the hood 8 that receives the pin 122, so as to constrain movement of the pin to a back-and-forth direction. A weight 130 is affixed or incorporated into each side of the guard 110. The weight 130 is shown in FIGS. 2 and 3 with hatch lines, for purposes of accentuation only. It is understood that the shape, location, and/or weight of the weight 130 may all vary, depending on the actual embodiment of the saw with which the guard 100 is intended to be used, and that the depictions of the shape and location of the weight 130 shown in the illustrated embodiment are not intended as limitations.

FIG. 3 is the same side plan view as that of FIG. 2, but shows the saw blade guard 100 in the raised position, with the unhooded portion 2A of saw blade 2 exposed, ready for a sawing operation. The guard 110 has been pivoted about the pivot means 112, thereby raising it and exposing the unhooded portion 2A of the saw blade 2. A second detent 128 is provided in the same guard 110 or side member that has the first detent 126. To raise the guard 110, the operator presses against the leaf spring 124 to release the locking pin 122 from the first detent 126. The guard 110 can now be swung upward so that the second detent 128 is brought in a position to receive the locking pin 122. This secures the guard 110 in the raised position.

FIG. 4 is a front cross-sectional view of the saw with the saw guard 100 in the closed position, showing the weights 130 that are incorporated into the side members 110A and 110B. The weights 130 serve to force the guard 110 to the closed position during a kick-back. When, for example, the workpiece binds the saw 10, the saw blade 2 forces the saw 10 to move in the upward direction very quickly and with a lot of force. The second detent 128 is constructed so as to provide a minimal holding force. The upward rotational force of the kick back will force the locking pin 122 out of the second detent and the guard 110 will swing very quickly to the closed position.

A stop may be provided on the hood 2, above the bridge 114, to prevent the guard 110 from swinging past the exposed portion 2A of the saw blade 2.

The safety guard 100 is illustrated on a circular saw, but it is understood, that the guard may easily be adapted for use with other types of handheld saws.

It is understood that the embodiments described herein are merely illustrative of the present invention. Variations in the construction of the safety guard may be contemplated by one skilled in the art without limiting the intended scope of the invention herein disclosed and as defined by the following claims.

What is claimed is:

1. A safety guard assembly for use with a handheld power saw, the handheld power saw having a saw blade and a hood that covers a portion of the saw blade, such that the saw blade has a hooded portion and an unhooded portion, the safety guard assembly comprising:

a safety guard that is adapted to cover the unhooded portion of the saw blade;

a mounting means for swingably attaching the safety guard to the hood;

a spring-biased locking mechanism affixed to the hood for selectively holding the safety guard in an open position in which the safety guard is moved away from the unhooded portion of the saw blade to enable a cutting operation and in a closed position in which the safety guard is moved over the unhooded portion to prevent a cutting operation; and a weight mounted on the safety guard, so as to enhance a moment of inertia that is inherently exerted on the safety guard in a kick-back situation, the moment of inertia enhanced by the weight automatically causing a release of the spring-biased locking mechanism from the open position and forcing the safety guard to swing from the open position to the closed position immediately upon kick-back.

2. The safety guard assembly of claim 1, wherein the safety guard includes two side members and the mounting means includes a pivot pin that extends from each side of the hood, each side member swingably mounted on the respective pivot pin.

3. The safety guard assembly of claim 2, wherein the weight is mounted on each of the two side members.

4. The safety guard assembly of claim 1, wherein the spring-biased locking mechanism includes a spring mechanism and a locking pin, wherein the safety guard includes a recess for receiving the locking pin, and wherein the spring mechanism urges the locking pin into the recess to hold the guard selectively in the open position or the closed position.

5. The safety guard assembly of claim 4, wherein the spring-biased locking mechanism is mounted on at least one side of the hood and the safety guard.

* * * * *